US008336354B2

(12) United States Patent
Haag et al.

(10) Patent No.: US 8,336,354 B2
(45) Date of Patent: Dec. 25, 2012

(54) INTERCHANGEABLE CARTRIDGE SYSTEM FOR A STRAIGHTENING MACHINE AND METHOD FOR OPERATING SAID STRAIGHTENING MACHINE

(75) Inventors: Uwe Haag, Neuenbürg (DE); Lothar Hug, Friesenheim (DE); Günter Keller, Friesenheim (DE); Wolfgang Leser, Lahr (DE)

(73) Assignee: Kohler Maschinebau GmbH, Friesenheim (DE)

( * ) Notice: Subject to any disclaimer, the term of this patent is extended or adjusted under 35 U.S.C. 154(b) by 165 days.

(21) Appl. No.: 12/680,054

(22) PCT Filed: Sep. 27, 2008 (Under 37 CFR 1.47)

(86) PCT No.: PCT/EP2008/008199

§ 371 (c)(1), (2), (4) Date: Aug. 9, 2010

(87) PCT Pub. No.: WO2009/043543

PCT Pub. Date: Apr. 9, 2009

(65) Prior Publication Data

US 2011/0005289 A1 Jan. 13, 2011

(30) Foreign Application Priority Data

Sep. 27, 2007 (DE) ..... 10 2007 046 138
Nov. 7, 2007 (DE) ..... 20 2007 015 406 U

(51) Int. Cl.
*B21D 1/02* (2006.01)

(52) U.S. Cl. ..... 72/164; 72/238

(58) Field of Classification Search ..... 72/160, 72/163–165, 237, 238, 444, 446, 448
See application file for complete search history.

(56) References Cited

U.S. PATENT DOCUMENTS

| | | | | |
|---|---|---|---|---|
| 4,811,586 | A * | 3/1989 | Benz et al. | 72/165 |
| 5,461,895 | A * | 10/1995 | Lemper et al. | 72/9.1 |
| 5,680,785 | A * | 10/1997 | Quehen et al. | 72/10.1 |
| 5,758,533 | A | 6/1998 | Quehen et al. | |
| 6,769,279 | B1 | 8/2004 | Bergman et al. | |
| 7,637,133 | B2 * | 12/2009 | Buta | 72/164 |

FOREIGN PATENT DOCUMENTS

| | | |
|---|---|---|
| DE | 30929 | 3/1885 |
| DE | 1250237 | 3/1968 |
| DE | 102004017558 | 10/2005 |
| JP | 62034623 | 2/1987 |
| WO | 2005080016 | 9/2005 |

* cited by examiner

*Primary Examiner* — Faye Francis
(74) *Attorney, Agent, or Firm* — Volpe and Koenig, P.C.

(57) ABSTRACT

A straightening machine (1) having upper straightening rollers (5.1, 5.2, . . . ) and lower straightening rollers (6.1, 6.2, . . . ) is provided, with the straightening rollers being drivable via coupling elements (5.1', 5.2', . . . ; 6.1', 6.2' . . . ). The upper straightening rollers and the lower straightening rollers are arranged in upper and lower interchangeable cartridges, respectively, together with the pertaining coupling elements, with the cartridges being removable from the straightening machine. The straightening machine provides that at least one of the upper and lower interchangeable cartridges is configured to be separable in such a manner that the relevant straightening rollers (6.1, 6.2, . . . ) can be exchanged optionally together with at least the pertaining coupling elements (5.1', 5.2', . . . ; 6.1', 6.2' . . . ) by removing the entire upper and/or lower interchangeable cartridge or without the pertaining coupling elements by removing only part of the relevant interchangeable cartridge. A method for operating the straightening machine is also provided.

14 Claims, 6 Drawing Sheets

INTERCHANGEABLE CARTRIDGE SYSTEM FOR A STRAIGHTENING MACHINE AND METHOD FOR OPERATING SAID STRAIGHTENING MACHINE

BACKGROUND

The present invention relates to a straightening machine with upper straightening rollers and with lower straightening rollers in which the straightening rollers can be driven by coupling elements and in which the upper straightening rollers and the lower straightening rollers, each with the associated coupling elements, are arranged in an upper or a lower interchangeable cartridge that can be removed from the straightening machine.

Furthermore, the present invention relates to an interchangeable cartridge system for such a straightening machine, comprising an upper straightening roller arrangement and a lower straightening roller arrangement, wherein the interchangeable cartridge system has, for the straightening rollers of the upper and/or the lower straightening roller arrangement, a coupling element arrangement for optionally connecting to a possibly present external gear-drive arrangement for the straightening machine.

Finally, the present invention also relates to a method for operating a straightening machine, comprising an interchangeable cartridge system according to the invention.

Straightening machines of the type noted above are known and are used for straightening blanks, bands, or the like, in particular, for the metal-working industry. Here, in the sense of the present description the straightening machines could have either a separate gear-drive arrangement that could be arranged externally, so that they are actively driven straightening machines, or, alternatively, a separate gear-drive arrangement for the straightening machines could be eliminated, so that these are driven or towed by a conveying motion of the straightening material, which is also designated at present as a "passive drive."

For retrofitting straightening machines to adapt to different materials to be straightened, that is, for exchanging straightening rollers for those with different diameters, straightening machines with interchangeable cartridges or interchangeable cartridge arrangements of the type noted above are known.

For example, the German unexamined patent application DE 10 2004 017 558 A1 describes a straightening machine with an interchangeable cartridge, wherein an additional distribution gear drive with an outlet for each straightening roller is arranged between a main gear drive for driving the straightening rollers and the straightening rollers.

Here, the distribution gear drive could be integrated into a straightening roller interchangeable cartridge, so that when straightening rollers with a changed diameter are used, the area of the straightening roller diameter that can be used and the corresponding number of straightening rollers can be increased. A disadvantage is that, in the case of the subject matter of the publication, in each case the coupling elements, in particular, in the form of articulated shafts, are exchanged together with the straightening rollers, which means increased complexity and thus leads to longer stoppage of the straightening machine, which is disadvantageous in terms of costs. Such state of the art is also disclosed in WO 2005/080016 A2.

Straightening machines with interchangeable cartridges are also known from GDR Patent 30 929, German Patent 1 250 237, as well as from U.S. Pat. Nos. 6,769,279 and 6,792,783.

Accordingly, from the state of the art it is also known to equip straightening machines with a quick-exchange possibility for exchanging straightening rollers for those of the same diameter and the same construction. Here, either the lower roller mill or the upper roller mill are pulled out to a great extent from the straightening machine without the corresponding coupling elements, e.g., articulated shafts, up to a stop, in order to be able to easily service or replace, for example, damaged straightening rollers or also dirty straightening rollers.

SUMMARY

The invention is based on the objective of providing an interchangeable cartridge arrangement for a straightening machine of the type noted above, a straightening machine of the type noted above, as well as a method for their operation, which create flexible exchanging possibilities for the straightening rollers and their coupling elements depending on the service, repair, or retrofitting work to be performed.

This objective is met by a straightening machine with the features of the invention, by an interchangeable cartridge arrangement for a straightening machine with the features of the invention, as well as by a method for operating a straightening machine with the features of the invention.

Advantageous constructions of the present invention are the subject matter of dependent claims whose wording is incorporated into the description herewith through explicit reference, in order to avoid the unnecessary repetition of text.

According to the invention, a straightening machine with upper straightening rollers and with lower straightening rollers, in which the straightening rollers can be driven by a possible gear-drive arrangement and articulated-shaft arrangement by suitable coupling elements and in which the upper straightening rollers and the lower straightening rollers are each arranged with the associated coupling elements in an upper or lower interchangeable cartridge that can be removed from the straightening machine, is characterized in that at least one of the upper and lower interchangeable cartridges has a construction that can be separated such that the relevant straightening rollers can be exchanged selectively at least with the associated coupling elements by removing the entire upper and/or lower interchangeable cartridge or without the associated coupling elements by removing only a part of the relevant interchangeable cartridge.

As already mentioned above, the straightening machine according to the invention can be actively driven accordingly, i.e., can have a separate gear-drive arrangement and articulated-shaft arrangement, or the straightening machine according to the invention is driven passively and has no such gear-drive arrangement and articulated-shaft arrangement.

An interchangeable cartridge arrangement for a straightening machine, in particular, for a straightening machine according to the invention, with an upper straightening roller arrangement and a lower straightening roller arrangement, wherein the interchangeable cartridge arrangement for the straightening rollers of the upper straightening roller arrangement and/or the straightening rollers of the lower straightening roller arrangement has a coupling element arrangement for optionally connecting to a possibly present external gear-drive arrangement and articulated-shaft arrangement of the straightening machine, provides according to the invention that the interchangeable cartridge arrangement has a construction that can be separated both in height between the upper straightening roller arrangement together with the associated coupling element arrangement and the lower straightening roller arrangement together with the associated coupling element arrangement and also in depth between at least one of the upper and lower straightening roller arrangements and the associated coupling element arrangement.

In addition, according to the invention a method for operating a straightening machine according to the invention that has an interchangeable cartridge arrangement according to the invention provides that, for a quick change, the upper and/or the lower straightening rollers are removed independent of the associated coupling elements, and that for a cartridge exchange, the upper and/or lower straightening rollers are removed together with the associated coupling elements.

An essential component of the present invention thus lies in the novel combination of the exchange possibilities realized disadvantageously until now only separately in conventional straightening machines. By dividing at least one of the upper and lower halves of the interchangeable cartridge arrangement, either a part of an upper or a lower interchangeable cartridge can be selectively pulled out from the straightening machine, in order to realize the quick-change variant, wherein the coupling elements, for example, in the form of articulated shafts, remain in the straightening machine or in a working area within the straightening machine. Alternatively, the interchangeable cartridge arrangement or at least one of the upper or lower interchangeable cartridges could be pulled undivided from the straightening machine, so that the coupling elements are removed, as is conventional, together with the straightening rollers in the cartridge from the straightening machine. Thus, according to the invention, the coupling elements could selectively remain "quick-change-like" in the straightening machine or could be removed "like an interchangeable cartridge" with the straightening rollers from the straightening machine. Thus, a more flexible operation of the straightening machine is possible, which advantageously leads, in particular, to shortened stoppage times during cleaning or changing of the straightening rollers of the straightening machine.

A first refinement of the straightening machine according to the invention provides that it has a gear-drive arrangement and articulated-shaft arrangement for actively driving the straightening rollers by the coupling elements.

A second, alternative refinement of the straightening machine according to the invention provides, in contrast, that the straightening machine is driven passively by a movement of the material to be straightened and/or the straightened material.

Another refinement of the straightening machine according to the invention provides that at least one of the upper and lower interchangeable cartridges has support arrangements that are separate from each other for the straightening rollers and for the coupling elements, in particular, for connecting the straightening rollers to the gear-drive arrangement, which are coupled, in particular, mechanically, by a coupling device so that they can be separated.

Alternatively, the coupling between the support arrangements could also be realized in another way, e.g., electromagnetically.

In particular, for the quick-change variant of the upper straightening rollers, it is advantageous when the support arrangement for the straightening rollers can be guided together with these straightening rollers independent of the support arrangement of the coupling elements, so that the upper straightening rollers do not bend or fall out due to their own weight in the case of a support arrangement on only one side.

For the simple movement or extension of the upper and lower interchangeable cartridges, in one refinement of the invention it can be provided that these are arranged at or on corresponding slide plates that can be moved out of the working area within the straightening machine. Here at least one of the upper and lower slide plates has a multi-part construction, wherein the corresponding separating line runs approximately in the area of the connection of the coupling elements to the straightening rollers.

Alternative constructions of the straightening machine according to the invention provide that, in the area of the lower roller mill, for the realization of the quick-change variant, the straightening roller support arrangement either remains in the working area within the straightening machine or moves outward with it. The outward movement of the lower straightening roller support arrangement therefore can be eliminated, in particular, because the lower straightening rollers as a rule do not bend or cannot fall out due to the force of gravity. In contrast, in the region of the upper roller mill, in the scope of the present invention it is regularly necessary that, especially for the realization of the quick-change variant, an upper straightening roller support arrangement moves out together with the straightening rollers from the working area within the straightening machine according to the invention, as already explained.

During the operation of the straightening machine, the individual parts of the interchangeable cartridges are held within the straightening machine by holding devices provided for this purpose, so that a secure connection of the entire roller arrangement is guaranteed. Here, in refinement of the present invention, in particular, also specially constructed coupling devices are provided that should prevent, in the case of possible roller bending and corresponding roller support bar supported so that it can pivot, the tipping of the latter, especially if, after a successful quick change, the relevant straightening rollers are inserted back in the machine.

In the case of another refinement of the straightening machine according to the invention, it is further provided that, in the case of a successful quick change, through a correspondingly constructed coupling device it is automatically ensured that the pivoting of the mentioned roller support bar is blocked. Conversely, in the case of the new use of the relevant straightening rollers, the ability to pivot is likewise automatically enabled again.

For the simplest realization possible for a complete cartridge change, in a refinement of the straightening machine according to the invention it is provided that the upper slide plate can be placed together with the upper interchangeable cartridge on the lower slide plate or the lower interchangeable cartridge and can be moved out in common and with the lower slide plate or the lower interchangeable cartridge from the working area in the straightening machine.

BRIEF DESCRIPTION OF THE DRAWINGS

Additional properties and advantages of the present invention are given from the subsequent description of embodiments with reference to the drawing. Shown are.

DETAILED DESCRIPTION OF THE PREFERRED EMBODIMENTS

Below, reference is repeated to an actively driven straightening machine, without the present invention being restricted to this.

Figure 1:
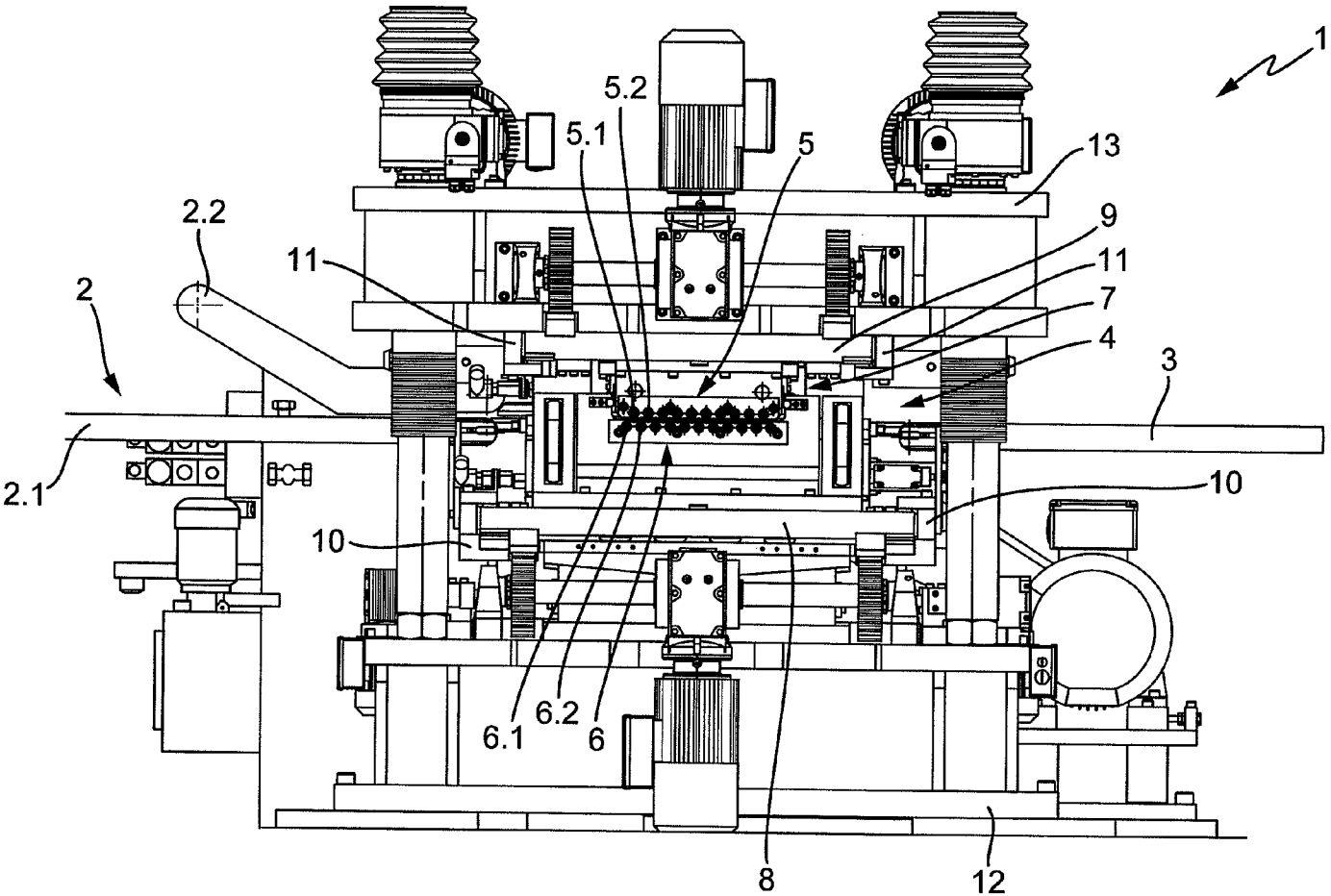
FIG. 1 an overall view of a straightening machine according to the invention, FIG. 2 a perspective detailed view of a construction of the straightening machine according to FIG. 1, FIG. 3 another perspective detailed view of the construction of the straightening machine in FIG. 1, FIG. 4 a perspective detailed view of the straightening machine in FIG. 2 and FIG. 3 in the course of a quick change in the region of the lower interchangeable cartridge, FIG. 5 a perspective detailed view of the straightening machine according to FIG. 2 and FIG. 3 in the course of a quick change in the region of the upper interchangeable cartridge, and FIG. 6 a perspective detailed view of the straightening machine according to FIG. 2 and FIG. 3 in the course of a change of the complete interchangeable cartridge arrangement from the upper and lower interchangeable cartridge (cartridge change).

FIG. 1 shows an overall view of a straightening machine according to the invention. The straightening machine 1 has an inlet 2 for materials to be straightened, such as, sheet metal, boards, or the like, with this inlet being formed from a lower inlet 2.1 and a pivotable upper inlet 2.2. The straightening machine 1 further has an outlet 3 for the straightened material. Between the inlet 2 and the outlet 3, an upper straightening roller arrangement 5 in the form of an upper straightening roller mill and a lower straightening roller arrangement 6 in the form of a lower straightening roller mill are provided within a working area 4 of the straightening machine 1, that is, in an area in which the straightening machine 1 performs the actual straightening work on the materials to be straightened. The upper straightening roller mill 5 has upper straightening rollers 5.1, 5.2, . . . arranged one behind the other and the lower straightening roller mill 6 has lower straightening rollers 6.1, 6.2, . . . likewise arranged one behind the other. The upper and lower straightening roller arrangements 5, 6 are part of an interchangeable cartridge arrangement 7, in order to be able to remove the straightening roller arrangements 5, 6 in a simple and flexible way from the working area 4 of the straightening machine 1, for example, for cleaning or service work, which will be discussed in more detail farther below. In this respect, the upper straightening roller arrangement 5 corresponds to an upper interchangeable cartridge and the lower straightening roller arrangement 6 corresponds to a lower interchangeable cartridge, wherein the upper and lower straightening roller arrangements 5, 6 or interchangeable cartridges form the interchangeable cartridge arrangement 7.

On one hand, with the lower roller mill 6, the interchangeable cartridge arrangement 7 is in active connection with a lower slide plate 8, that is, it is arranged on the lower slide plate 8, wherein the slide plate 8 can be moved out from the working area 4 of the straightening machine 1 by a suitable drive (not designated explicitly in FIG. 1) (perpendicular to the plane of the drawing in the direction toward the viewer). Furthermore, the interchangeable cartridge arrangement 7, in particular, the upper roller mill 5, is in active connection with a multiple-part upper slide plate 9 that can be moved from the straightening machine 1 or the working area 4 perpendicular to the plane of the plate also by a drive that is not shown further. For the lower slide plate 8 and the upper slide plate 9, there are pairs of guide rails 10 and 11, respectively, that are fixed on a lower or upper platform 12, 13 of the straightening machine 1.

Figure 2:
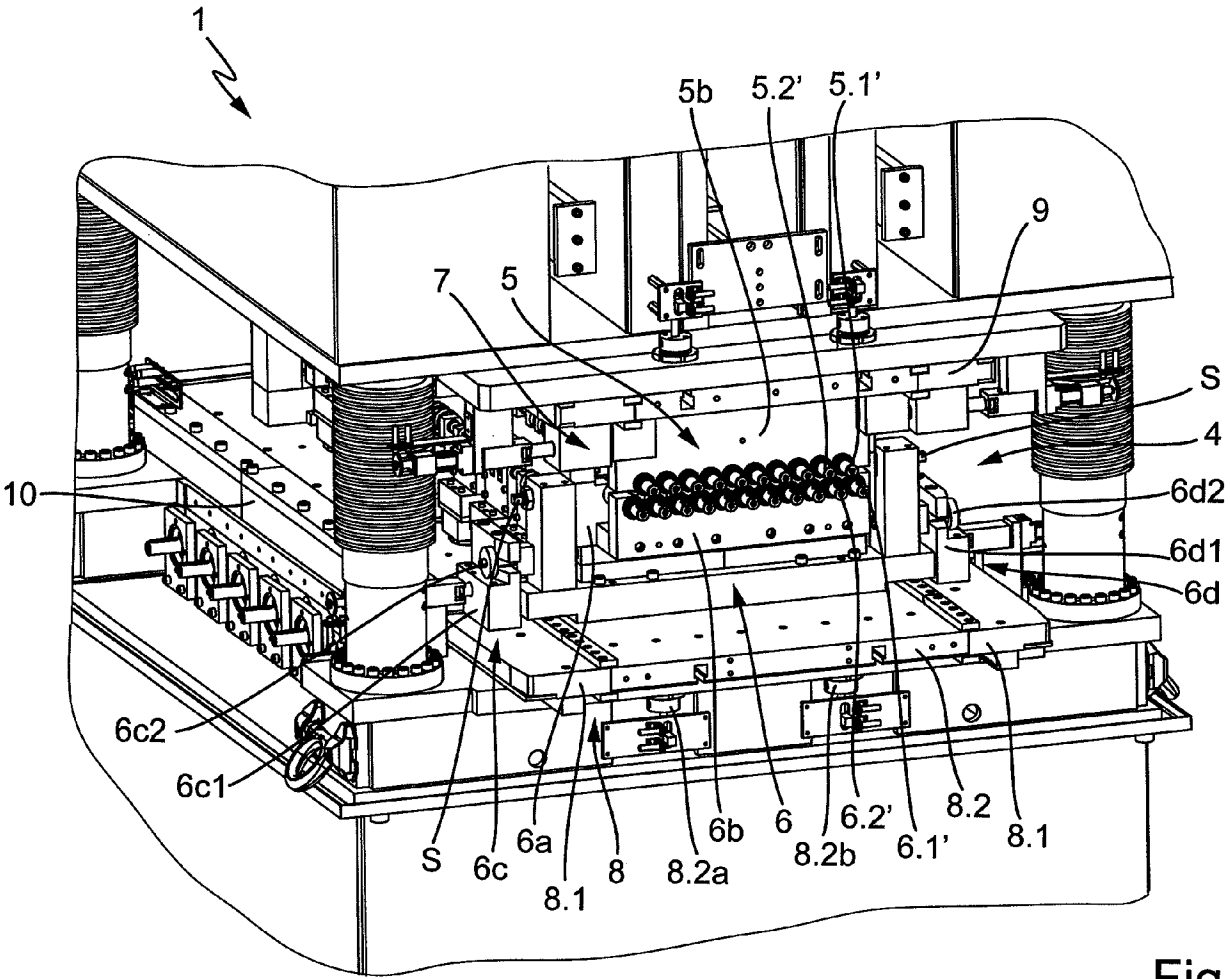

FIG. 2 shows a perspective, detailed view of a construction of the straightening machine according to FIG. 1. In the diagram according to FIG. 2, the outward movement of the slide plates 8, 9 is realized, in contrast to FIG. 1, at an angle backward into the plane of the sheet and not forward as described above with reference to FIG. 1.

At present, only the special features of the diagram according to FIG. 2 will be discussed in detail: as is to be seen in FIG. 2 for only the lower roller mill 6, this has a roller support bar 6*a* that can pivot for the purpose of possible straightening roller bending about the axis S and on which a coupling support bar 6*b* extending parallel to the first is mounted, in particular, screwed. A corresponding coupling support bar 5*b* is also to be seen for the upper roller mill 5, while the upper roller support bar—not visible in FIG. 2—is located behind. In the coupling support bars 5*b*, 6*b*, coupling parts 5.1', 5.2', . . . ; 6.1', 6.2', . . . are mounted that are used for connecting the straightening rollers not visible in FIG. 2 with a gear-drive arrangement (not shown for reasons of visibility) for driving the straightening rollers. The lower slide plate 8 is constructed, as is visible, in two parts 8.1, 8.2, wherein the roller support bar is arranged and fixed on the (second) slide plate part 8.2 that is movable relative to the other (first) slide plate part 8.1, as long as there is no forced coupling between the two parts 8.1, 8.2, which will be discussed in more detail farther below. Underneath the second slide plate part 8.2 there are pinch cylinders 8.2*a, b* by which, in particular, the plate part 8.2 can be fixed in a defined way during the operation of the straightening machine 1 or for realizing a quick change.

The roller support bar 6*a* and coupling support bar 6*b* arranged on the second slide plate part 8.2 on one hand and also the remaining lower straightening roller arrangement on the other hand, i.e., the first slide plate part 8.1 can be connected or coupled mechanically on both sides by coupling devices 6*c*, 6*d*, 6*e* with the rest of the lower roller mill 6 to the lower interchangeable cartridge. The coupling devices 6*c*, 6*d* each include a first coupling part 6*c*1, 6*d*1 that is mounted on the first slide plate part 8.1 and a second coupling part or anti-tilting part 6*c*2, 6*d*2 that is arranged on the roller support bar 6*a* and can be drawn through suitable biasing/spring means (not visible) into this bar, in order to prevent yielding or tilting of the roller support bar 6a when the straightening rollers of the lower roller mill 6 are inserted, which will be discussed in even more detail farther below with reference to FIG. 4. For this purpose, the first coupling part 6*c*1, 6*d*1 is connected rigidly to the rest of the lower roller mill, so that it results in a positive-fit interaction between the first coupling part 6*c*1, 6*d*1 and the second coupling part 6*c*2, 6*d*2 held in a recess in the first coupling part 6*c*1, 6*d*1 connected with a movement of the second coupling part 6*c*2, 6*d*2 in the direction of or against the spring biasing, when the two coupling parts 6*c*1, 6*d*1 or 6*c*2, 6*d*2 move relative to each other.

As an alternative to the purely-mechanically-active first and second coupling parts 6*c*1, 6*c*2; 6*d*1, 6*d*2 described above, in the case of other constructions of the straightening machine according to the invention, for example, the provision of electromagnetic or other, alternative coupling devices 6*c*, 6*d* for protecting against tilting of the pivotable, lower roller support bar 6*a* is also possible. Furthermore, the first coupling part 6*c*1, 6*d*1 also fulfills another function for coupling/decoupling the first and second slide plate parts 8.1, 8.2, i.e., for selectively realizing a cartridge change or a quick change, which will also be discussed in more detail farther below.

Figure 3:
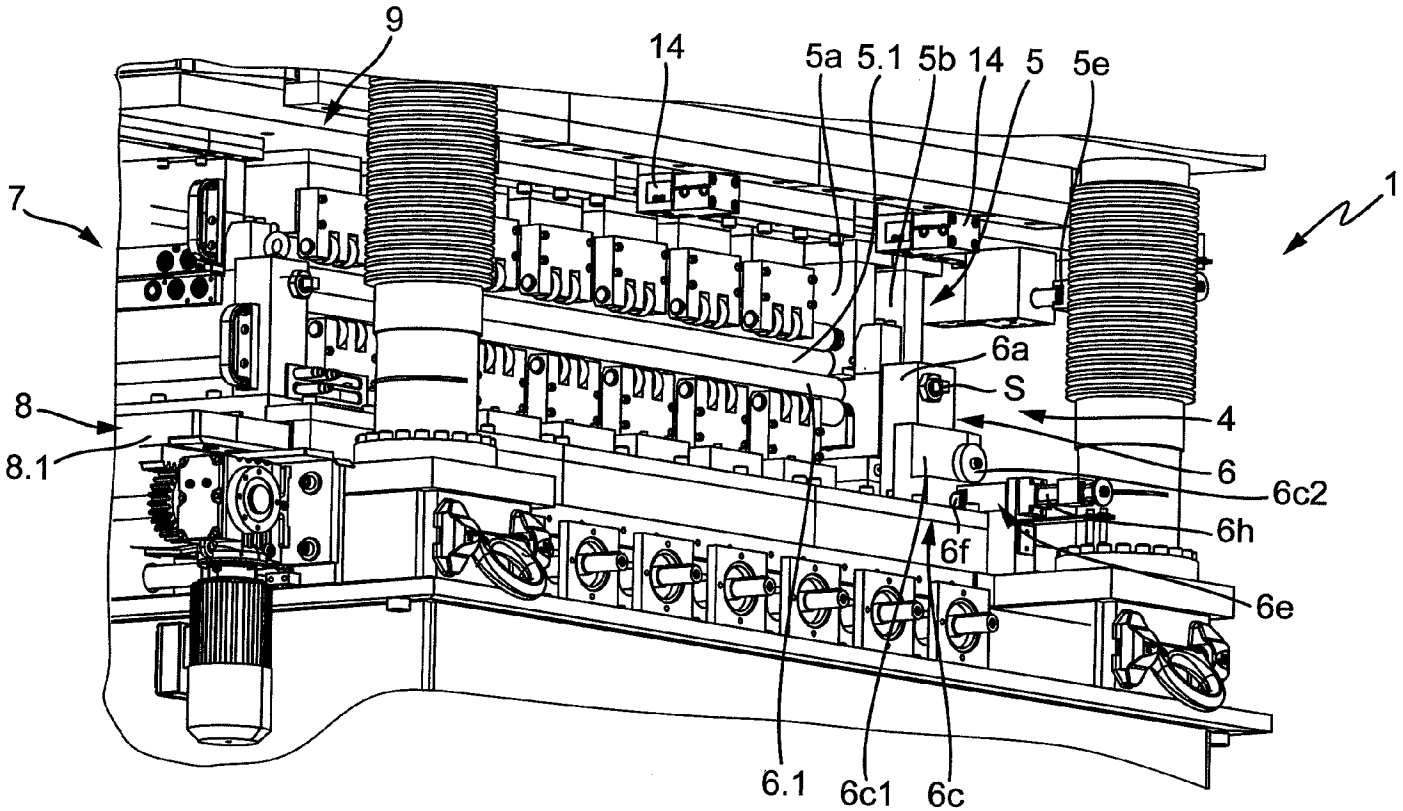

FIG. 3 shows another perspective detailed view of the construction of the straightening machine in FIG. 1. In the diagram according to FIG. 3, the outward movement of the interchangeable cartridge arrangement 7 takes place in the direction toward the left side of the image. In FIG. 3, the arrangement of the straightening rollers 5.1, 6.1 is easy to see in the upper or lower straightening roller mills 5, 6. Furthermore, FIG. 3 also shows in the area of the upper roller mill 5 now separated a roller support bar 5*a* and a coupling support bar 5*b* set apart (cf. roller support bar 6*a* and coupling support bar 6*b* of the lower roller mill 6 in FIG. 2), which are also arranged on different parts (not visible in FIG. 3) of the upper slide plate 9. For reference numbers 14, holding devices for the upper slide plate 9 are shown that are constructed as pinch cylinders. These can be activated pneumatically, hydraulically, (electro) mechanically, or also in other suitable ways.

Furthermore, in the diagram in FIG. 3, additional upper or lower coupling devices 5*e*, 6*e* are to be taken that are also already visible in FIG. 2 and were already mentioned in this respect. These are arranged on both sides of the upper roller mill 5 and the lower roller mill 6, respectively, and are used together with the already mentioned first coupling parts 6*c*1, 6*d*1 for coupling the roller support bar 5*a* and the coupling support bar 5*b* of the upper roller mill 5, i.e., the different components of the upper slide plate 9 (cf. FIG. 5) and the slide plate parts 8.1 and 8.2, respectively (with roller support bar 6*a* and coupling support bar 6*b*) of the lower roller mill 6. The exact construction of the mentioned additional holding devices in the region of the upper roller mill 5 is to be taken especially from FIG. 5 still to be described below; for the lower roller mill 6, refer to FIG. 4.

Figure 4:
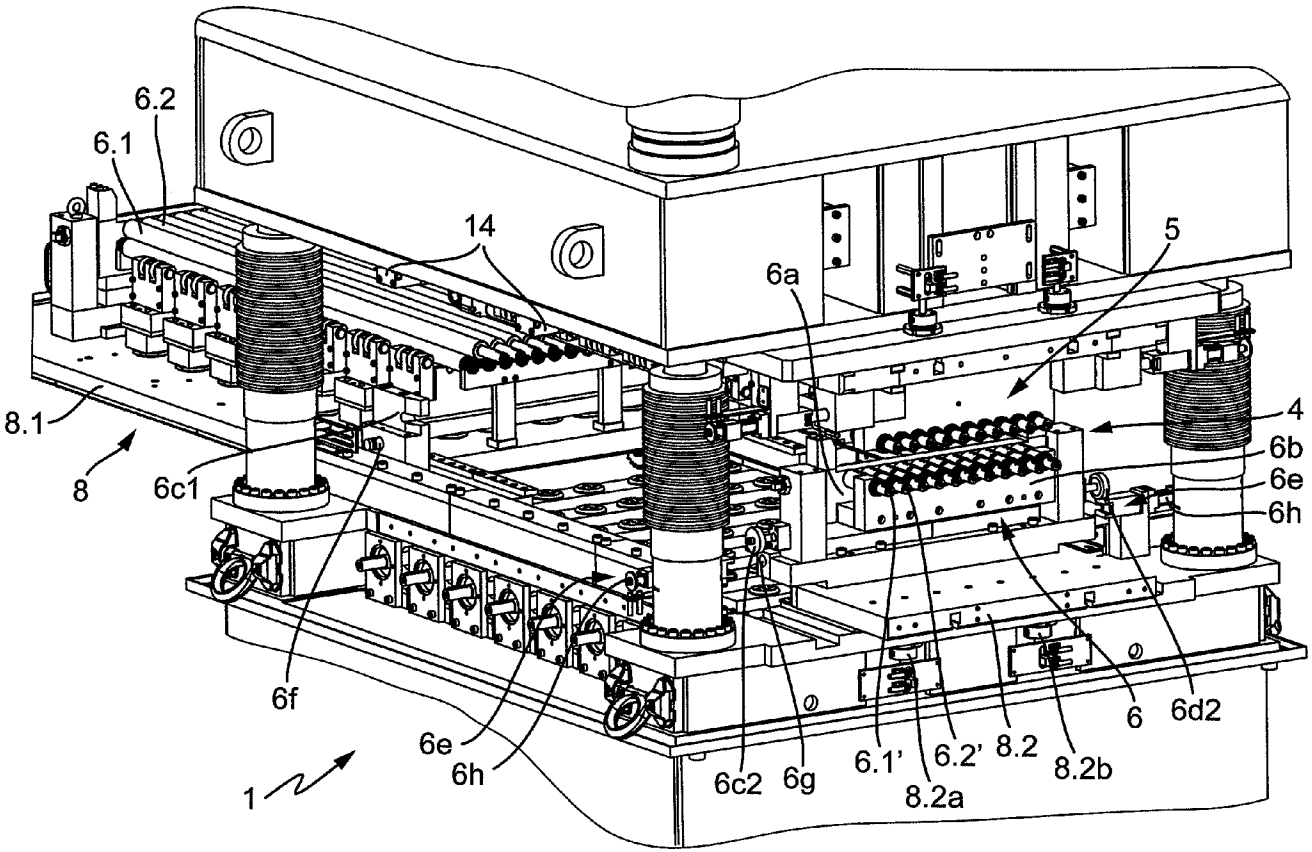
Figure 5:
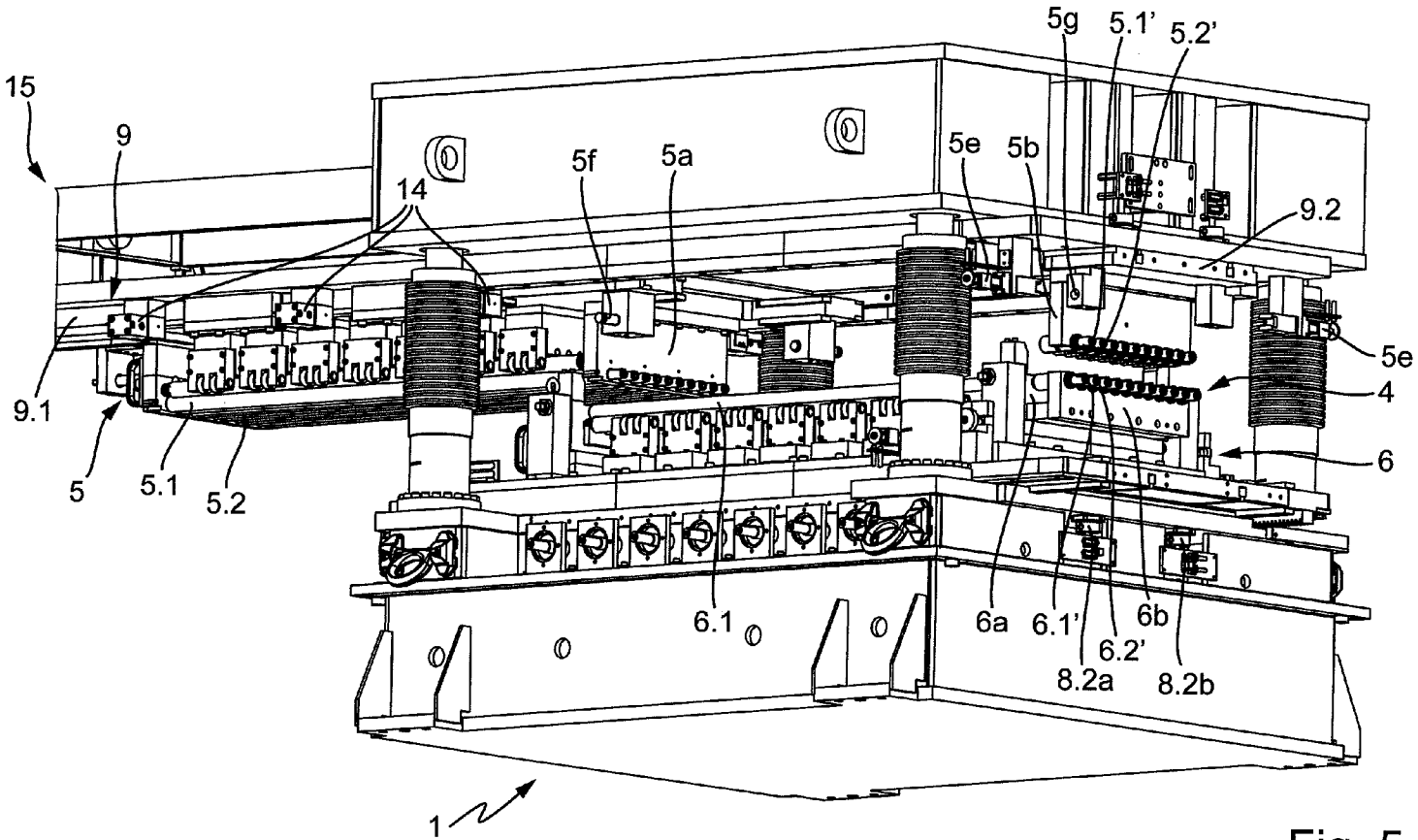
Figure 6:
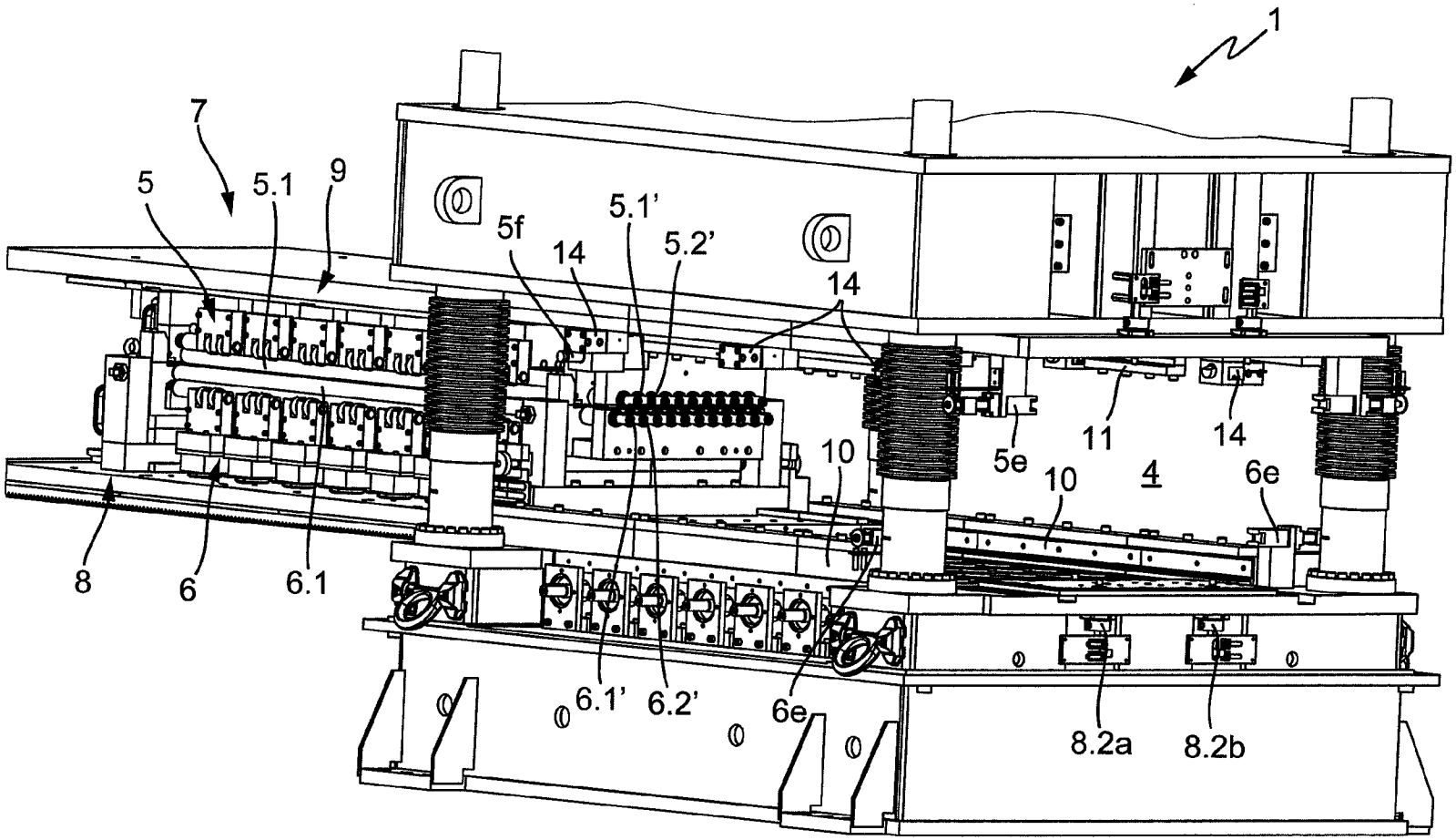

Due to the division of the interchangeable cartridge arrangement 7 into two parts according to the invention in height, that is, between the upper roller mill 5 and lower roller mill 6 (in two separate interchangeable cartridges) and also in depth, that is, within each interchangeable cartridge, for example, between upper roller support bar 5*a* and upper coupling support bar 5*b*, in the case of a straightening machine 1 according to the invention, for purposes of cleaning, service, roller exchange, or the like, a plurality of flexible removal options for the interchangeable cartridge arrangement 7, as a whole or in parts, is created, which will be discussed in more detail below with reference to FIGS. 4 to 6. Here, in all of the figures, the same reference symbols designate elements that are identical or that have identical actions.

FIG. 4 shows a detailed view of a straightening machine 1 according to the invention somewhat corresponding to the view in FIG. 2, but in the course of a quick change of the lower straightening rollers 6.1, 6.2, . . . For this purpose, the entire upper roller mill 5 is initially lifted slightly. The lower coupling devices 6*c*, 6*d* (cf. FIG. 2) are detached from their active connection with the mentioned additional coupling devices 6*e*, so that, in the area of the lower roller mill 6, the roller support bar 6*a* and the coupling support bar 6*b*, on one hand, as well as the remaining lower roller arrangement, on the other hand, are no longer mechanically coupled and thus can be separated.

As is to be seen particularly well in FIG. 4, the illustrated embodiment provides that in a continuous borehole of the first coupling part 6*c*1, a bolt 6*f* is arranged moveably that, in the coupled state, engages inward in a corresponding holder 6*g* on the coupling support bar 6*b*, when the holding device 6*e* (e.g., a hydraulic cylinder) acts from the outside on the bolt 6*f* (cf., in particular, FIG. 3 in connection with FIG. 4). In order to couple the components of the lower roller mill 6, as shown, e.g., in FIGS. 2 and 3, for corresponding movement of the slide plate part 8.1 in the direction toward the second slide plate part 8.2, the bolt 6*f* moves in a corresponding holder in the end of the coupling devices 6*e* turned inward with respect to the straightening machine 1. The latter are stationary relative to the straightening machine 1 and can press the bolt 6*f* inward, i.e., at least partially by the part 6*c*1, 6*d*1 in the holder 6*g* onto the roller support bar 6*a* through corresponding control of a hydraulic cylinder 6*h* or the like, in order, in this way, to couple all of the components of the lower part of the interchangeable cartridge 7 including the slide plate parts 8.1, 8.2 with respect to the inward and outward movement into and out from the working area 4 of the straightening machine 1, respectively.

Conversely, the coupling device 6*e* can pull the bolt 6*f* outward from the holder 6*g*, in order to decouple or to separate the lower part of the interchangeable cartridge 7 in depth, so that, for a quick change, only the straightening rollers 6.1, 6.2, . . . can be removed from the working area 4 (together with any provided roller bending devices or the like, as known by someone skilled in the art).

Then the lower straightening rollers 6.1, 6.2, . . . are driven out by the lower slide plate 8, i.e., the first slide plate part 8.1 from the working area 4 in the interior of the straightening machine 1, as already explained above with reference to FIG. 1. The additional components of the drive device (not shown in FIG. 4) for driving the straightening rollers 6.1, 6.2, . . . that are arranged—as said—on the slide plate part 8.2 can remain connected to the coupling parts 6.1', 6.2', . . . , so that a quick change of the straightening roller is possible.

As is to be taken, in particular, from FIG. 4 and—as described above—also already from FIGS. 2 and 3, the lower slide plate 8 divides into the first part 8.1 and the second part 8.2, wherein the separation between the parts 8.1, 8.2 is arranged or constructed just in the connection area between the roller support bar 6*a* and the rest of the lower roller mill 6 with the straightening rollers 6.1, 6.2, . . . After the detachment of the lower coupling devices 6*e* explained in detail above (pulling back the bolt 6*f* from the holder 6*g*), it is consequently possible to move only the first part 8.1 of the lower slide plate 8 from the working area 4 of the straightening machine 1, as shown in FIG. 4. Here, the second coupling part 6*c*2, 6*d*2 of the lower coupling devices 6*c*, 6*d* is "freed" from the recess in the first coupling part 6*c*1, 6*d*1 and automatically moves inward due to the spring effect mentioned above, in order, in this way, to block the pivoting movement of the lower roller support bar 6*a*. This is important, so that, during the retraction (re-insertion) of the lower straightening rollers 6.1, 6.2, . . . engagement with the coupling elements 6.1', 6.2', . . . can be realized without a problem, without these being able to yield due to the pivoting of the roller support bar 6*a* (and thus also the coupling support bar 6*b*).

When the first part 8.1 of the slide plate 8 is retracted, conversely, the second coupling part 6*c*2, 6*d*2 of the lower coupling devices 6*c*, 6*d* then engages again in the mentioned recess in the associated first coupling part 6*c*1, 6*d*1, so that, through the use of a bevel or chamfer on the first coupling part 6*c*1, 6*d*1 (cf. FIG. 2), the second coupling part 6*c*2, 6*d*2 is pulled little by little from the coupling support bar 6*a* again, by which the locking of the pivoting is canceled. The roller support bar 6*a* and the coupling support bar 6*b* on one hand and also the remaining lower roller mill 6 on the other hand and, in this way, the first and second parts 8.1, 8.2 of the lower slide plate 8 can then by mechanically coupled or connected rigidly by the additional coupling devices 6*e* in interaction with the bolt 6*f* and holder 6*g*, as described in detail above.

According to the diagram in FIG. 4, however, all of the connections between the roller support bar 6*a* and the coupling support bar 6*b* on one hand and also the rest of the lower straightening roller arrangement on the other hand are detached, so that the interchangeable cartridge arrangement 7 or its lower part (lower interchangeable cartridge) formed from the lower roller mill 6 is separated in depth, in order to allow a quick change just of the straightening rollers 6.1, 6.2, . . . of the lower roller mill 6.

The view of the diagram in FIG. 5 corresponds essentially to that in FIG. 4, only that, in the present, a quick change of the straightening rollers 5.1, 5.2, . . . of the upper roller mill 5 is shown. As FIG. 5 also shows in this context, the upper slide plate also divides into a first part 9.1 on which, in particular, the roller support bar 5*a* is arranged and a second part 9.2 on which the coupling support bar 5*b* is arranged.

As is still to be taken from FIG. 5, the upper coupling devices 5*e* for the upper interchangeable cartridge or a part of these devices are formed analogous to the lower coupling devices 6*e* that were described in detail above with reference to FIG. 4. In particular, in this context, the upper roller mill 5 also has corresponding bolt elements 5*f* on the roller support bar 5*a* as well as holders 5*g* on the coupling bar 5*b*.

In contrast to the description given above for FIG. 4, during the upper quick change according to FIG. 5, the upper roller support bar 5*a* moves outward together with the upper slide plate 9 or the first upper slide plate part 9.1, so that the upper straightening rollers 5.1, 5.2, . . . are constantly held on both sides and are not bent or even fall downward by the force of gravity. That is, the separation of the upper interchangeable cartridge in depth is realized between the roller support bar 5*a* that is arranged on the first upper slide plate part 9.1 and the coupling support bar 5*b* that is arranged on the second upper slide plate part 9.2. The pinch cylinders 14 fix the first upper slide plate part 9.1 on an upper quick-change structure 15 that can move outward and move outward with this structure from the working area 4 within the straightening machine 1, as shown in FIG. 5.

The upper coupling devices 5*e* (cf. FIG. 3) that correspond with respect to construction and function to the coupling devices 6*e* already explained in detail (cf. FIG. 4) are detached, so that the roller support bar 5*a* can be moved outward separated from the coupling support bar 5*b*. In other words: due to the fact that, in FIG. 5, the bolt 5*f* on the roller support bar 5*a* is not pushed into the corresponding holder 5*g* on the coupling bar 5*b* or held therein due to the effect of the coupling device 5*e*, a quick change on the upper roller mill 5 can be performed, because the upper straightening rollers 5.1, 5.2, . . . can be removed without the coupling support bar 5*b* and corresponding to the coupling elements 5.1', 5.2', . . . (as well as the not-shown articulated shafts, gear-drive arrangement, . . . ), as shown in FIG. 5.

As an alternative to the shown constructions, in the scope of the present invention it is also possible that the lower coupling support bar 6*b* is not screwed tightly onto the roller support bar 6*a*, but is connected to the latter in a way that can be detached or separated instead by disconnecting corresponding connections that can be formed analogous to those on the upper roller mill 5, so that, in deviation from the construction according to FIG. 4, for the lower quick change, the roller support bar 6a moves out together with the other straightening rollers 6.1, 6.2, . . .

FIG. 6 shows, with reference to a diagram that corresponds essentially to that in FIG. 5, a complete cartridge change, that is, an exchange of the entire interchangeable cartridge arrangement 7. For this purpose, the entire upper slide plate 9, that is, the first and second upper slide plate parts 9.1, 9.2, is detached by controlling the pinch cylinders 14 remaining within the working area 4 of the straightening machine 1 and is placed on the lower straightening roller arrangement 6 together with straightening rollers 5.1, 5.2, . . . , roller support bar 5*a*, and coupling support bar 5*b*. The interchangeable cartridge arrangement 7 then moves from the working area 4 on the lower slide plate 8 and can be easily exchanged accordingly. Here, the reliable connection between the components of the interchangeable cartridge 7 is guaranteed in depth, in particular, in the area of the lower roller mill 6 by the coupling devices 6*e* on the lower roller mill 6.

Furthermore, it can be taken from FIG. 6 how a mechanical connection of the upper interchangeable cartridge parts can be achieved in depth through the engagement of the upper bolt 5*f* in the corresponding holders 5*g* (cf. FIG. 5) through the use of the upper coupling devices 5*e*.

As someone skilled in the art recognizes, an interchangeable cartridge arrangement 7 that can be divided both in height and also in depth can also be used or retrofitted in existing straightening machines.

The invention claimed is:

1. Straightening machine comprising an upper straightening roller arrangement with upper straightening rollers and a lower straightening roller arrangement with lower straightening rollers, wherein the upper straightening roller arrangement is formed as an upper interchangeable cartridge and the lower straightening roller arrangement is formed as a lower interchangeable cartridge, the upper interchangeable cartridge and the lower interchangeable cartridge together forming an interchangeable cartridge arrangement that is divided by height into two parts that are separately or commonly removable, and wherein the interchangeable cartridge arrangement is also divided in depth in each one of the upper interchangeable cartridge and the lower interchangeable cartridge, wherein the upper interchangeable cartridge is divided in depth between an upper roller support bar and an upper coupling support bar and the lower interchangeable cartridge is divided in depth between a lower roller support bar and a lower coupling support bar, wherein the upper and lower straightening rollers are driveable by respective coupling elements and the upper straightening rollers are arranged with associated ones of the coupling elements in the upper interchangeable cartridge and the lower straightening rollers are arranged with associated ones of the coupling elements in the lower interchangeable cartridge.

2. Straightening machine according to claim 1, further comprising a gear-drive arrangement and an articulated-shaft arrangement for actively driving the straightening rollers by the coupling elements.

3. Straightening machine according to at claim 2, wherein at least one of the upper and lower interchangeable cartridges has separate support arrangements for the straightening rollers and for the coupling elements for connecting the straightening rollers with the gear-drive arrangement and the articulated-shaft arrangement, which are coupled by a coupling device so that they are separable.

4. Straightening machine according to claim 3, the straightening roller and coupling support arrangements can be moved together or separately out from a working area in the straightening machine.

5. Straightening machine according to claim 4, wherein the upper and lower interchangeable cartridges are arranged on upper and lower slide plates, respectively, that can be moved out from the working area in the straightening machine and at least one of the upper and lower slide plates has a multiple-part construction, wherein a separation between the slide plate parts runs in an area of a connection of the coupling elements with the straightening rollers.

6. Straightening machine according to claim 5, wherein a holding device in the form of an arrangement of pinch cylinders, is constructed for acting on at least one of the slide plate parts of the upper interchangeable cartridges, in order to be able to fix the at least one of the slide plate parts on a structure that can be moved out from the working area of the straightening machine.

7. Straightening machine according to claim 6, wherein a part of the holding device can be moved with the relevant slide plate out from the working area in the straightening machine.

8. Straightening machine according to claim 6, wherein a part of the holding device can be moved with the relevant slide plate part out from the working area in the straightening machine.

9. Straightening machine according to claim 5, wherein the upper slide plate can be placed together with the upper interchangeable cartridge on the lower slide plate and can be moved together with the lower slide plate out from the working area in the straightening machine.

10. Straightening machine according to claim 5, wherein the upper slide plate can be placed together with the upper interchangeable cartridge on the lower interchangeable cartridge and can be moved together with the lower interchangeable cartridge out from the working area in the straightening machine.

11. Straightening machine according to claim 3, wherein at least one of the upper and lower straightening roller support arrangements is supported so that it can pivot for allowing a tilting of a straightening roller and a corresponding device is provided for blocking a pivoting capability in an extended state of the relevant interchangeable cartridge part.

12. Straightening machine according to claim 3, the straightening roller and coupling support arrangements can be moved separately out from a working area in the straightening machine.

13. Straightening machine according to claim 1, wherein the straightening rollers are mounted for rotation such that the straightening machine is driven passively by a movement of at least one of material to be straightened or straightened material.

14. Straightening machine according to claim 1, wherein at least one coupling device for coupling the interchangeable cartridge parts of at least one of the upper or the lower interchangeable cartridges is provided on the straightening machine.

* * * * *